United States Patent [19]

Seugnet

[11] 4,118,327

[45] Oct. 3, 1978

[54] FABRIC SOFTENER AND ANTI-STATIC COMPOSITIONS

[75] Inventor: Monique Seugnet, Colombes, France

[73] Assignee: Colgate Palmolive Company, New York, N.Y.

[21] Appl. No.: 777,994

[22] Filed: Mar. 28, 1977

[51] Int. Cl.[2] ..... D06M 13/44

[52] U.S. Cl. ..... 252/8.8; 8/115.6; 252/8.6; 252/8.9

[58] Field of Search ..... 252/8.8, 8.6, 8.9; 8/115.6

[56] References Cited

U.S. PATENT DOCUMENTS

| | | | |
|---|---|---|---|
| 2,286,794 | 6/1942 | Dickey et al. | 252/8.8 R |
| 3,033,889 | 5/1962 | Chiddix et al. | 252/8.6 |
| 3,346,670 | 10/1967 | Papalos | 252/DIG. 17 |
| 3,591,405 | 7/1971 | McCarty | 252/8.6 |
| 3,622,378 | 11/1971 | Proffitt | 8/115.6 |
| 3,957,661 | 5/1976 | Verite | 252/8.9 |

*Primary Examiner*—William E. Schulz
*Attorney, Agent, or Firm*—Norman Blumenkopf; Herbert S. Sylvester; Murray M. Grill

[57] ABSTRACT

Phosphoric acid esters, which are anionic anti-static agents, are incorporated into conventional cationic fabric softeners for addition to the rinse cycle of automatic home laundry machines or for the final rinse in an industrial fabric treating process. The static electricity accumulation of synthetic fabrics, especially nylon, is reduced to substantially the same degree as cotton and softening is enhanced. The compositions are preferably in the form of aqueous solutions, dispersions or emulsions.

14 Claims, No Drawings

FABRIC SOFTENER AND ANTI-STATIC COMPOSITIONS

BACKGROUND OF THE INVENTION

1. Field of Invention

This invention relates to fabric softening and anti-static compositions and a method of softening fabrics and preventing static electricity from accumulating on said fabrics. More particularly, this invention relates to improved fabric softening compositions in which an anti-static compound has been incorporated, such compositions being particularly adaptable to the treatment of fabrics during the rinse cycle of conventional home washing machines and to the treatment of fabrics with said compositions. In a particular aspect this invention relates to a treating composition which includes a cationic softening agent and an anionic phosphoric acid ester anti-static agent which when applied to synthetic fabrics, including nylon will both soften the fabric and decrease the static electricity to substantially the same degree as cotton.

2. State of the Prior Art

The use of various and diverse chemical materials and particularly cationic quaternary ammonium compounds as softeners for textile products is very well known in the art. It is also well known to employ such materials for their softening effect during the laundering operation and particularly in the rinse cycle of the laundering process. This technique has been necessitated by the fact that the softeners heretofore employed, being mainly cationic in nature, are not compatible with the major type of detergent used in the washing cycle. By far, the predominating type of detergent used in home laundering processes, is anionic in nature and more particularly is of the alkali metal higher-alkyl benzene sulfonate type. To employ a cationic substance, such as the aforementioned softeners, in conjunction with anionic detergent materials, results in a precipitate which is completely ineffective as a fabric softener. This manifestation of incompatibility is also undesirable because it removes detergent from the wash cycle and therefore requires more detergent to accomplish the necessary and desired washing efficiency. As a consequence of these difficulties, it has been absolutely necessary to add the presently available cationic softeners to the clothes in the absence of any anionic detergent and where this is done during washing it must be done during the rinsing cycle.

It is also well known that there is a tendency for laundered articles to yellow when treated with cationic agents. This yellowing of the textiles treated with cationics is believed to be caused by (1) highly colored impurities or by-products in some commercial cationic finishing agents or (2) the presence of high amounts of iron in the finishing agents that may cause staining typical of iron compounds or, (3) due to the presence of alkali when the materials treated with the cationics are ironed or pressed.

A further disadvantage of the cationic fabric softeners is that many of them are waxy or gummy in nature making them difficult to weigh or measure, to mix or disperse with other textile-treating agents, and to place them in a form which may be readily applied to textiles.

There have been several recent developments of anionic softening agents which are substantially compatible with many conventional liquid and/or solid heavy duty detergent compositions and also many of the newly developed softening agents also impart satisfactory anti-static property to many synthetic textile fibers or are compatible with anti-static agents.

U.S. Pat. No. 3,951,826 describes a single phase, all purpose heavy duty liquid detergent composition which contributes softening and anti-static properties to laundry. This aqueous composition uses a mixture of mono- and diphosphate esters of higher alkyl ethoxylates and lower alkyl mono- and diphosphate esters in combination with nonionic detergent and builder. The mixture of ethoxylated phosphate esters is disclosed to impart softening and anionic detergent properties to the composition.

U.S. Pat. No. 3,957,661 describes heavy duty laundry detergent in particulate form having softening properties which combines mono- and di-higher alcohol polyethoxy phosphate ester salts with synthetic anionic organic detergents. It is also suggested that in addition to softening effects the detergent composition imparts an anti-static action during the laundering of synthetic materials.

A detergent-compatible fabric softening and anti-static composition containing molecular smectite clay materials, cationic anti-static agents and acidic compatibilizing agents which permit the simultaneous attainment of fabric softening, static-reduction and cleansing effects of fabrics washed therein is described in U.S. Pat. No. 3,954,632. The smectite clay softeners are anionic as are the conventional cleansing substances in detergent compositions and therefore, as previously described, the cationic anti-static agents are generally ineffective in such compositions. Accordingly, the patentee utilizes compatibilizing agents with substantially water-insoluble quaternary ammonium anti-static agent of the formula $[R_1R_2R_3R_4N]^+{}_nX^{n-}$ wherein $R_1$ and $R_2$ represent hydrocarbyl groups containing from about 10 to 22 carbon atoms, $R_3$ and $R_4$ represent hydrocarbyl groups containing from about 1 to 4 carbon atoms, X is an anion and $n$ is an integer from 1 to 3. It is also suggested in this patent that the quaternary ammonium anti-static agent adds an increment of softening benefits to the fabrics.

U.S. Pat. Nos. 3,862,058, 3,886,075, 3,954,632 and 3,958,059 are directed to fabric treatment compositions which have fabric softening and anti-static properties. The anti-static agents used in these patents comprise a quaternary compound of nitrogen or phosphorous and electrically conductive salts. In U.S. Pat. No. 3,959,155 the anti-static compositions comprising an electrically conductive metal salt dispersed in water-insoluble quaternary compound are employed as detergent-compatible fabric softeners with anionic smectite clay softeners.

U.S. Pat. No. 3,862,045 discloses fabric softening anti-static compositions which include quaternary ammonium salts having two long-chain alkyl groups having 16 to 22 carbon atoms as the softening ingredient and at least one anti-static agent which is an ethoxylated quaternary ammonium compound having the formula $[R_1R_2(CH_2CH_2O)_mH(CH_2CH_2O)_nH]^+X^-$ wherein $R_1$ is an alkyl group having 14 to 22 carbon atoms, $R_2$ stands for an alkyl group having 1 to 3 carbon atoms or a benzyl group, X designates Cl, Br, or $C_2H_5SO_4$, and the sum of $m$ and $n$ is from 5 to 20, or quaternary ammonium compounds expressed by the formula $R_3R_4R_5N^+(CH_2)_pCOO^-$ wherein $R_3$ is an alkyl group having 16 to 22 carbon atoms, $R_4$ and $R_5$ stand independently for an alkyl group having 1 to 3 carbon atoms and $p$ is a number of from 1 to 4. These compositions also include nonionic surfactants and at least one additive selected from alcohols, glycols, glycerol, sorbitol and urea. This patent also shows a series of comparative examples wherein phosphate esters were used as anti-static agents but were shown to have undesirable results. In U.S. Pat. No. 3,850,818 the ethoxylated quaternary ammonium salts having the previously given formula are combined with quaternary ammonium salts having the formula $R_1R_2R_3R_4N^+X^-$ wherein $R_1$ and $R_2$ each represent an alkyl group of 14 to 22 carbon atoms, $R_3$ and $R_4$ each represent an alkyl group of 1 to 3 carbon atoms, benzyl or $(C_2H_4O)_nH$ wherein $n$ is an integer of from 1 to 3 and X represents Cl, Br or $C_2H_5SO_4$, the combination of these two quaternary ammonium salts forming an anti-static softening composition.

In addition to such general formulations, there have also been disclosures of anti-static finishing agents having particular adaptability for synthetic fibers such as polyesters and polyamides. For example, U.S. Pat. No. 2,676,122 discloses that mixtures of amine salts of long-chain alkyl phosphates, whereof the amine portion is an oxy-alkylene amine, such as mono-, di- and triethanol amine, the ethanol derivative of monomethyl and dimethyl amine and morpholine, as described by the following general formula:

$$(AlkO)_x-\overset{\overset{\displaystyle O}{\|}}{P}-[O(NX)H]_y$$

wherein $x$ designates the numeral 1 or 2 while $y$ is the difference between 3 and $x$, Alk is a normal alkyl radical having from 8 to 16 carbon atoms, and NX represents an oxyalkylene amine have excellent anti-static effects upon non-cellulosic, hydrophobic textile materials including nylon, polyacrylonitrile, polyethylene terephthalate, etc.

U.S. Pat. No. 3,684,567 describes an anti-static finish for nylon textiles which is durable through laundering. The anti-static finish is applied to the nylon textile fabtic as a solution or solvent dispersion of an ethanolamine of the formula $$R-O-CH_2\overset{\overset{\displaystyle OH}{|}}{C}HCH_2NHCH_2CH_2OH$$

where R is an alkyl radical of 8 to 18 carbon atoms.

U.S. Pat. No. 3,634,117 describes the use of various amine salts of polyethoxyalkyl phosphoric acid esters, N-diamines of quaternary ammonium salts and especially acyl-amino-propyl-dialkyl-ammonium dialkyl phosphates as finishing agents for fibrous or filamentary polyester and polyamide textile materials.

The extensive research and development in this area has led to several commercially fabric softeners which, in addition to their fabric softener qualities, impart satisfactory anti-static effect for most of the synthetic textile fabrics such as polyester fabrics and acrylic fabrics. However, the effectiveness of these fabric softeners have not been entirely satisfactory with regard to their anti-static effect on nylon fibers and the fabrics utilizing such nylon fibers.

SUMMARY OF THE INVENTION

It was therefore desired to modify conventional cationic fabric softeners to improve their anti-static effect on nylon fabrics. In seeking to solve this problem, attempts were made to incorporate into conventional cationic fabric softeners, several different anti-static agents commonly used in various applications such as the textile industry, paper industry, plastics industry, record manufacturing, etc. These attempts centered primarily on the known cationic anti-static agents such as salts of substituted amines or salts of quaternary ammonium or quaternary alkoxy ammonium compounds since it was expected that the cationic anti-static agents would be most compatible with and most effective when added to the cationic fabric softeners. However, these combinations of cationic fabric softeners and cationic anti-static agents were still not entirely satisfactory with regard to the suppression of static electricity on nylon fabrics. The term "fabric softening" as used herein and as known in the art refers to a process whereby a desirably soft handle and fluffy appearance are imparted to fabrics.

It was, therefore, quite unexpected when it was discovered that anionic phosphorous-containing anti-static agents substantially improved the anti-static effect of conventional cationic fabric softeners and in fact, in a preferred embodiment of the present invention, the combination of cationic fabric softener and anionic phosphate anti-static agent suppress the accumulation of static electricity on nylon fabrics to the same extent as cotton, for which there is no significant problem of static electricity accumulation.

Accordingly, it is an object of the present invention to provide fabric softening compositions which have substantial anti-static effect on nylon fabrics and to a method of treating nylon fabrics to substantially decrease their electrical resistance.

It is a further object of the present invention to provide such improved fabric softening composition having particular utility when applied to the rinse cycle of a conventional home laundering machine.

It is a further object of the present invention to provide such improved fabric softening composition which is highly stable with time and which will not adversely effect the softening properties of the cationic fabric softener.

These and other objects and advantages of the present invention will become more apparent from the following, more detailed description thereof.

DETAILED DESCRIPTION OF THE INVENTION

The composition of the present invention which obviates the above disadvantages and which is primarily intended for use as an aqueous fabric softening composition added to the rinse cycle in a home laundering machine consists essentially of an aqueous solution or solvent dispersion of a cationic fabric softening agent and an anionic anti-static agent selected from the group consisting of phosphates, phosphoric acids, phosphoric esters and salts thereof. The cationic softening agent is present in the composition in an amount sufficient to provide on the fabric on a weight basis the cationic fabric softener in an amount ranging from about 0.005 to about 0.3% by weight, preferably from about 0.01 to about 0.2% by weight and most preferably from about 0.05 to about 0.15% by weight. The anionic phosphorus-containing anti-static agent is present in the fabric softener composition in an amount ranging from about 0.1 to about 5% by weight and preferably from about 0.5 to about 3% by weight of the total composition.

Since most top loading automatic washing machines have a capacity of about 15 to 20 gallons, the concentrated form of the composition will generally include 0.1 to 10%, preferably 1 to 8% by weight, of the cationic softening agent. While substantially any of the known anionic phosphorous-containing anti-static agents can be used in the composition and method of the present invention, the preferred compounds are the mono- and di-phosphoric esters and their salts and particularly phosphoric acid mono- and di-esters of higher fatty alcohol polyethoxy ethanols and their salts. Compounds of this nature are described in the above-mentioned U.S. Pat. Nos. 3,957,661 and 3,951,826. Although these patents suggest that the solid or liquid detergent compositions including the phosphoric acid esters impart some anti-static properties to the detergent in addition to their softening properties and their detergent properties, it is not suggested that these anionic compounds would be compatible with the conventional cationic softening agents or would be particularly useful for treatment of nylon fabrics. Furthermore, these patents only show the use of the salts of these phosphoric acid esters and do not suggest the similar utility of the free acid form which latter form has been found to be particularly effective in the compositions and method of the present invention.

The ethoxylated higher fatty alcohol monophosphoric ester di-salt and corresponding diester mono-salt which are the preferred anti-static agents in the present application have the following general structural formula: $R^1O(CH_2CH_2O)_mPO(OM)_2$ wherein $R^1$ is a higher alkyl of 14 to 20 carbon atoms, $m$ is a number of from 1 to 10 and M is hydrogen, an alkali metal, preferably sodium or potassium or ammonium; and $[R^1O(CH_2CH_2O)_m]_2POOM$ wherein $R^1$, $m$ and M have the same meanings as previously given. The lower molecular weight mono- and di-phosphoric esters and salts have the formula $R_2OPO(OM)_2$ and $(R^2O)_2POOM$ wherein $R^2$ is alkyl of 6 to 10 carbon atoms and M is as defined above.

Most preferably the ethoxylated higher fatty alcohol monophosphoric ester di-salt and di-ester mono-salt will be present together at a ratio of monoester to diester of from about 4:1 to 2:3.

Methods for the manufacture of the phosphate esters and mixtures thereof are described in British Pat. No. 1,012,418. The acid form of such mixtures is available under various trademarks, for example, Berol TVM-729 marketed by Berol Aktiebolaget (Sweden). When the salt form is desired neutralization may be effected with alkaline metal hydroxides, such as sodium hydroxide, or with other known neutralizing basic compounds, such as carbonates or phosphates, with the stoichiometric amount being employed to produce the desired complete neutralization of the phosphoric esters.

In the above formula $R^1$ is preferably alkyl of 16 to 18 carbon atoms including mixtures thereof and $m$ is preferably from 2 to 8.

The cationic fabric softening compounds useful in the composition of the present invention generally comprise cationic nitrogen containing compounds, such as quaternary ammonium compounds and amines containing one or two straight chained organic radicals of at least 8 carbon atoms and preferably containing at least one straight chained organic radical containing from 12 to 22 carbon atoms.

Generally, the quaternary ammonium softening agents have the following formulas

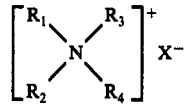

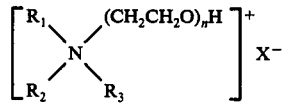

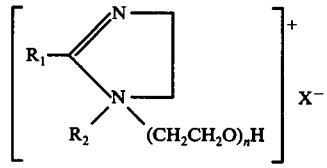

wherein $R_1$ is a long chain aliphatic radical having from 8 to 22 carbon atoms, $R_2$ is a long chained aliphatic radical having from 8 to 22 carbon atoms or is a lower alkyl radical having from 1 to 4 carbon atoms, $R_3$ and $R_4$ are lower alkyl radicals, $n$ is a number between 1 and 15 and X is a water soluble salt forming anion, such as a halide, i.e. chloride, bromide, iodide; a sulfate, acetate, hydroxide, methasulfate or similar inorganic or inorganic solubilizing mono- or dibasic radical. Examples of quaternary ammonium softening agents suitable for use in the composition of the present invention include the following: hydrogenated ditallow dimethyl ammonium chloride, ethoxylated distearyl dimethyl ammonium chloride, 1-hydroxyethyl-1-methyl-2-heptadecyl imidazolinium chloride; dimethyl distearyl ammonium chloride; trimethyl stearyl ammonium bromide; cetyl trimethyl ammonium chloride, di-coco dimethyl ammonium chloride; cetyl pyridinium chloride; higher alkyl dimethyl benzyl ammonium chloride; di-isobutyl phenoxy ethoxy ethyl dimethyl benzyl ammonium chloride; lauryl isoquinolinium bromide; distearyl dimethyl quaternary ammonium bromide; distearyl dimethyl quaternary ammonium methylsulfate; dicoco dimethyl quaternary ammonium chloride; dimethyl arachidyl, behenyl quaternary ammonium chloride; di-(soya) dimethylammonium chloride, and di-(coco) dimethylammonium chloride.

Examples of amines which may be utilized in the composition of the present invention include primary tallow amine, primary coco amine, primary halogenated tallow amine, n-tallow, 1,3-propylene diamine, oleyl 1,3-propylene diamine, and coco 1,3-propylene diamine.

The term "coco" when utilized refers to fatty acid groups formed in coconut oil fatty acids. Such acids contain from about 8 to 18 carbon atoms per molecule predominating in the $C_{12-14}$ acids. The cationic fabric softeners may be used singly or in mixtures of 2 or more.

The phosphorous-containing anti-static agents and the cationic fabric softeners are generally available as solid powders and may be mixed together as such or with additional conventional fillers and other adjuvants and then formulated as a concentrated aqueous solution or solvent dispersion or emulsion.

Suitable fillers include sodium chloride, clay, diatomaceous earth, silica containing compounds, borax, boric acid, etc. Other adjuvants such as re-wetting aids, e.g. ethoxylated nonylphenols, ethoxylated aliphatic alcohols or ethoxylated di-fatty methylammonium halides, germicides, whiteners, dyes and perfurmes can also be included. These fillers and other adjuvants may be present in the composition in amounts up to about 25% by weight of the solid composition.

In formulating the aqueous liquid fabric softener composition of the present invention, it is simply necessary to add the anti-static agent to conventional cationic fabric softener solutions. The anti-static agent will be added in the amount of from about 0.1 to 5% by weight and preferably from about 0.5 to about 3% by weight based on the total composition.

While the fabric softening compositions of the present invention have particular utility in the formation of their aqueous liquid solutions or dispersions for application to the rinse cycle of automatic home washing machines and exhibit their most significant advantage with regard to the treatment of nylon fabrics, it is understood that the compositions and method of the present invention have broader utility for use in commercial operations and for both natural and synthetic fabrics other than nylon such as polyesters, polyacrylics, and the like. Moreover, any of the conventional nylons such as Nylon 6, Nylon 11, Nylon 12, Nylon 66, Nylon 610, Nylon 611, and Nylon 612 are equally advantageously treated with the improved fabric softening compositions of the present invention.

While water is the preferred liquid carrier, water-alcohol mixtures containing less than 50% by weight, preferably less than 10% by weight of alcohol can also be used. Suitable alcohols include methanol, ethanol, propanol, iso-propanol, butanol, etc. and diols such as ethylene glycol, propylene glycol and the like. The liquid carrier can comprise from about 60% to about 99% by weight of the total composition.

Stabilizing ingredients or solubilizers such as long-chain fatty amides, urea, sodium xylene sulfonate and the like are also preferably contained in the composition in amounts up to about 20% by weight, preferably up to about 10% by weight of the total composition.

The following non-limitative examples further illustrate the present invention and the advantages thereof.

EXAMPLE I

This example demonstrates the ability of the improved fabric softening composition of the present invention in reducing the accumulation of static-electricity on synthetic materials and particularly nylon.

Swatches of nylon taffeta, spun nylon, Banlon and cotton, each 10 by 12 centimeters were washed and then rinsed with 2 g/l of fabric softener solution. After spinning and drying the swatches were conditioned at 20° C., 45% relative humidity for 36 hours. The electrical resistance of the treated swatches were then measured across their thickness using an ultramegohm-meter sold by Lemouzy. The following products were used as the final rinse:

(A) - control: dimethyldistearyl ammonium chloride at a concentration of 6%;

(B) - (A) in which was incorporated 1% Hostaphat MDGE S 080 (phosphoric ester from Hoechst based on $C_{16}$-$C_{18}$ alcohol, EO 8:1, ratio mono/diester = 4);

(C) - (A) in which was incorporated 1% Hostaphat MDGE S 020 (phosphoric ester from Hoechst based on $C_{16}$-$C_{18}$ alcohol EO 2:1);

(D) - (A) in which was incorporated 1% Gafac RS 710 (phosphoric ester from GAF, structure unknown);

(E) - (A) in which was incorporated 1% of P.E. 122 (phosphoric ester from Knapsack based on lauryl alcohol, EO 4:1, ratio mono/diester = 2);

(F) - tap water.

The following results, expressed as ohms $\times 10^{10}$ per mm were obtained:

| Treatment with | (A) | (B) | (C) | (D) | (E) | (F) |
|---|---|---|---|---|---|---|
| Nylon taffeta | 108 | 5.5 | 37.5 | 25 | 23.5 | 740 |
| Spun Nylon | 140.5 | 3 | 40.9 | 15.2 | 10 | 329 |
| Banlon | 79.6 | 3.6 | 33.3 | 7.9 | 19 | 1467 |
| Cotton | 2.3 | 2.1 | 2.5 | 2.3 | 2.6 | 3.5 |

As seen from the above table, while the dimethyldistearyl ammonium chloride decreases the resistance of the treated nylon taffeta and spun nylon substantially below that of the tap water, it is seen that the incorporation of the phosphoric acid esters and particularly product (B) further decrease the electric resistance several orders of magnitude below the fabric softener to which the phosphoric acid ester has not been added. Similar results are seen with the treatment of Banlon.

Furthermore, it is seen that the improved fabric softening compositions of the present invention reduce the tendency of the nylon fabric to accumulate static charges to substantially the same extent as cotton which is known not to have any substantial problem with regard to the accumulation of static electricity.

In addition, when the compositions (B), (C), (D) and (E) were again tested after storage for a period of several months substantially the same results were obtained.

EXAMPLE II

This example shows that the phosphoric acid esters of the present invention also contribute to the softening properties of the conventional fabric softeners.

A 3 kg cotton load containing 8 terry cloth towels was rinsed for 15 minutes at 20° C. in 30 liters of tap water containing 1.6 g/l of fabric softener. After the treated terry cloths were spun dry, 24 panelists were asked to compare the softness and give their preference for the following products:

(A) Conventional fabric softener with 6% dimethyldistearyl ammonium chloride;

(G) Conventional fabric softener containing 4.4% of dimethyldistearyl ammonium chloride;

(H) Conventional fabric softener containing 4.4% of dimethyldistearyl ammonium chloride and 0.8% Hostaphat MDGE S 020.

The panelists did not find a significant difference between the towels treated with compositions (A) and (H). Moreover, the towels treated with compositions (A) and (H) were significantly preferred to those treated with (G). A sequential statistical test was utilized to determine whether the differences observed by the panelists were significant or not significant.

It is clear from these examples that the incorporation of the phosphoric ester acid and the conventional cationic fabric softener composition significantly improves the suppression of accumulation of static electrical charges on synthetic fabrics and particularly nylon while at the same time contributing to the softening of the treated fabrics.

The invention has been described with respect to various illustrations and examples thereof which are not intended to be limitative since it will be evident to one of skill in the art how modifications may be made, equivalents employed and substitutes utilized without departing from the spirit or scope of the invention.

What is claimed is:

1. A fabric softening and anti-static composition consisting essentially of:

(1) from about 0.1% to about 5% by weight of the total composition of at least one phosphoric acid ester or a salt thereof selected from the group consisting of $R^1O(CH_2CH_2O)_mPO(OM)_2$ I $[R^1O(CH_2CH_2O)_m]_2$ POOM II $R^2OPO(OM)_2$ and III $(R^2O)_2POOM$ IV wherein $R^1$ is a higher alkyl of 14 to 20 carbon atoms, *m* is from 1 to 10, M is a hydrogen, alkali metal or ammonium and $R^2$ is an alkyl of 6 to 10 carbon atoms, and (2) from about 0.1 to about 10% by weight of the total composition of at least one cationic fabric softening agent.

2. The composition of claim 1 in the form of an aqueous solution solvent dispersion or emulsion.

3. The composition of claim 1 wherein the cationic fabric softener is quaternary ammonium compound or imidazolinium compound selected from the group consisting of

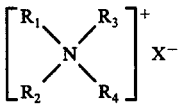

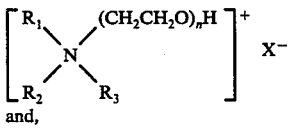

and,

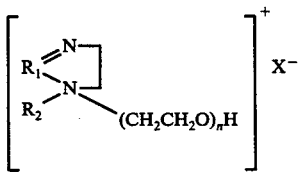

4. The composition of claim 1 wherein the anionic phosphoric acid ester anti-static agent is a mixture of the compounds of formula (I) and (II) at a mole ratio of mono-ester (I) to diester (II) of from about 4:1 to about 2:3.

5. The composition of claim 4 wherein $R^1$ is an alkyl of 1 to 18 carbon atoms or mixtures thereof and *m* is 2 to 8.

6. In a method for treating textile fabrics in order to reduce the tendency for accumulation of static electricity and simultaneously impart softness to the treated fabric, the improvement which comprises applying to said textile fabric a fabric softener composition which comprises (1) from about 0.1 to 5% by weight of at least one phosphorus acid ester selected from the group consisting of $R^1O(CH_2CH_2O)_mPO(OM)_2$ (I)

$[R^1O(CH_2CH_2O)_m]_2POOM$ (II)

$R^2OPO(OM)_2$ and (III)

$(R^2O)_2POOM$ (IV)

and (2) from about 0.1 to 10% by weight of at least one cationic fabric softening agent.

7. The method of claim 6 wherein the anionic phosphoric acid ester anti-static agent is a mixture of the compounds of formula (I) and (II) at a mole ratio of mono-ester (I) to diester (II) of from about 4:1 to about 2:3 and $R^1$ is an alkyl of 16 to 18 carbon atoms or mixtures thereof and *m* is 2 to 8.

8. The method of claim 6 wherein the textile fabrics include nylon.

9. A fabric softening and anti-static composition consisting essentially of (1) from about 0.1% to about 5% by weight of the total composition of at least one phosphoric acid ester or salt thereof selected from the group consisting of $R^1O(CH_2CH_2O)_m$ $PO(OM)_2$ and I $R^1O(CH_2CH_2O)_{m\ 2}POOm$ II and mixtures of (I) and (II) at a mole ratio of mono-ester (I) to diester (II) of from about 4:1 to about 2:3, and wherein $R^1$ is higher alkyl of 14 to 20 carbon atoms, *m* is from 1 to 10 and M is hydrogen, alkali metal or ammonium, and (2) from about 0.1 to 10% by weight of the total composition of at least one cationic fabric softening agent.

10. The composition of claim 9 wherein *m* is from 2 to 8.

11. The composition of claim 9 wherein said cationic softener is dimethyldistearyl ammonium chloride.

12. The composition of claim 9 wherein the weight ratio of cationic softener to phosphoric compound is about 6:1.

13. The composition of claim 11 wherein $R^1$ is from 16 to 18, *m* is 8 and the mole ratio of mono-ester (I) to diester (II) is about 4.

14. In a method for treating textile fabrics in order to reduce the tendency for accumulation of static electricity and simultaneously impart softness to the treated fabric, the improvement which comprises applying to said textile fabric the fabric softening and anti-static composition of claim 9.

* * * * *